US012291983B2

(12) United States Patent
Kujak et al.

(10) Patent No.: US 12,291,983 B2
(45) Date of Patent: May 6, 2025

(54) MECHANICAL CAM PHASING SYSTEMS AND METHODS

(71) Applicant: HUSCO Automotive Holdings LLC, Waukesha, WI (US)

(72) Inventors: Michael Kujak, Hartland, WI (US); Austin Schmitt, Hartland, WI (US); Todd Wollenberg, Milwaukee, WI (US)

(73) Assignee: HUSCO Automotive Holdings LLC, Waukesha, WI (US)

( * ) Notice: Subject to any disclaimer, the term of this patent is extended or adjusted under 35 U.S.C. 154(b) by 0 days.

(21) Appl. No.: 18/351,901

(22) Filed: Jul. 13, 2023

(65) Prior Publication Data

US 2024/0018886 A1 Jan. 18, 2024

Related U.S. Application Data

(60) Provisional application No. 63/395,564, filed on Aug. 5, 2022, provisional application No. 63/389,699, filed on Jul. 15, 2022.

(51) Int. Cl.
*F01L 1/352* (2006.01)
*F01L 1/344* (2006.01)

(52) U.S. Cl.
CPC ..... *F01L 1/352* (2013.01); *F01L 2001/34466* (2013.01); *F01L 2800/00* (2013.01)

(58) Field of Classification Search
CPC ..... F01L 1/352; F01L 2001/34466
See application file for complete search history.

(56) References Cited

U.S. PATENT DOCUMENTS 5,337,711 A * 8/1994 Hampton ..... F16D 3/10 123/90.31
6,192,842 B1 * 2/2001 Haag ..... F01L 1/3442 123/90.31
10,072,537 B2 * 9/2018 Schmitt ..... F01L 1/34409
11,053,990 B2 * 7/2021 Kujak ..... F16D 41/064
(Continued)

FOREIGN PATENT DOCUMENTS

JP 2010001877 A 1/2010

OTHER PUBLICATIONS

European Patent Office, Extended European Search Report, Application No. 23185620.4, Dec. 15, 2023, 11 pages.

*Primary Examiner* — Ngoc T Nguyen
(74) *Attorney, Agent, or Firm* — Quarles & Brady LLP

(57) ABSTRACT

Systems and method for a cam phaser are provided. In some configurations, the cam phaser includes a drive member having a first mating surface, a driven member having a second mating surface, and a locking mechanism arranged between the first mating surface and the second mating surface. The locking mechanism is operable to contact the first mating surface and the second mating surface, in response to an outside force applied to the driven member that loads the locking mechanism. The cam phaser further includes an engaging member. The engaging member is configured to selectively actuate the locking mechanism to enable rotation of the driven member relative to the drive member. The cam phaser may include a reaction mechanism configured to receive additional force from an input mechanism and selectively transmit the additional force to the driven member to unload the locking mechanism.

20 Claims, 18 Drawing Sheets

(56) References Cited

U.S. PATENT DOCUMENTS

| | | | | |
|---|---|---|---|---|
| 2011/0011359 | A1 | 1/2011 | Ai | |
| 2017/0022855 | A1* | 1/2017 | Schmitt | F01L 1/047 |
| 2020/0182106 | A1* | 6/2020 | Kujak | F01L 1/34403 |
| 2021/0148256 | A1 | 5/2021 | Kujak et al. | |
| 2022/0195898 | A1 | 6/2022 | Van Weelden et al. | |

* cited by examiner

MECHANICAL CAM PHASING SYSTEMS AND METHODS

CROSS-REFERENCES TO RELATED APPLICATIONS

This application is based on, claims priority to, and incorporates herein by reference in its entirety U.S. Provisional Patent Application No. 63/389,699, filed on Jul. 15, 2022, and entitled "Mechanical Cam Phasing Systems and Methods" and U.S. Provisional Patent Application No. 63/395,564, filed on Aug. 5, 2022, and entitled "Mechanical Cam Phasing Systems and Methods."

STATEMENT REGARDING FEDERALLY SPONSORED RESEARCH

Not Applicable.

BACKGROUND

Rotary systems (e.g., engines, motors, etc.) may include a drive member and a driven member that is rotationally driven by the drive member. In some cases, a locking mechanism can be positioned between the drive member and the driven member to control the relative movement therebetween.

BRIEF SUMMARY

The present disclosure relates generally to systems and methods of cam phasing and, in particular, to systems and methods of unlocking a locking mechanism of the cam phaser to enable relative rotation of components of the phaser.

According to one aspect of the disclosure, a cam phaser can include a drive member and a driven member. A locking mechanism can be operable to contact the drive member and the driven member in response to a first torque applied to the driven member that loads the locking mechanism. An engaging member can be configured to selectively actuate the locking mechanism to enable rotation of the driven member relative to the drive member. A reaction mechanism can be configured to receive a second torque from an input mechanism. The reaction mechanism can be configured to selectively transmit the second torque to the driven member to unload the locking mechanism to allow the locking mechanism to move from a locked state to an unlocked state.

In some non-limiting examples, the drive member can be configured to couple to a crankshaft, and the driven member can be configured to couple to a camshaft. The drive member can include a first mating surface and the driven member can include a second mating surface. The locking mechanism can be arranged between the first mating surface and the second mating surface. The locking mechanism can include a first locking member and a second locking member, which can be biased away from one another by a biasing element. In some cases, each of the first locking member and the second locking member can be configured as a roller bearing.

In some non-limiting examples, the engaging member can include one or more tabs extending from a first surface. The one or more tabs can be configured to engage with the locking mechanism to unlock the locking mechanism. In some cases, the reaction mechanism can be configured as a reaction gearbox that can include a planetary geartrain. The engaging member can include a post extending from a second surface, opposite the first surface, the post being configured to receive a planet gear of the planetary geartrain. The planetary geartrain can include a modular gear having first teeth that form a sun gear of the planetary geartrain of the reaction gearbox and second teeth configured to engage with the input mechanism. A ring gear of the planetary geartrain of the reaction gearbox can define a cutout configured to receive the driven member.

In some non-limiting examples, the reaction mechanism can be configured to selectively transmit the second torque to the engaging member to unlock the locking mechanism. When the locking mechanism is in an unloaded state, the engaging member can displace the locking mechanism. When the locking mechanism displaces the locking mechanism, the driven member can displace relative to the drive member.

In some non-limiting examples, in response to the second torque applied by the input mechanism, the reaction mechanism can transmit a first output torque to the engaging member and a second output torque to the driven member. The first output torque and the second output torque can be applied in opposite rotational directions.

According to another aspect of the disclosure, a cam phaser can include a drive member including a first mating surface and a driven member including a second mating surface. A locking mechanism can be arranged between the first mating surface and the second mating surface and can be operable to contact the first mating surface and the second mating surface in response to a first torque applied to driven member that loads the locking mechanism. An engaging member can be configured to selectively actuate the locking mechanism to enable rotation of the driven member relative to the drive member. A reaction gearbox can include a planetary geartrain configured to selectively transmit a second torque from an input mechanism to the driven member to unload the locking mechanism, and the planetary geartrain can be configured to selectively transmit the second torque to the engaging member to unlock the locking mechanism.

In some non-limiting examples, the engaging member can include one or more tabs extending from a first surface. The one or more tabs can be configured to engage with the locking mechanism to unlock the locking mechanism. In some cases, the engaging member can include one or more posts extending from a second surface, opposite the first surface. The one or more posts can be configured to receive one or more planet gears of the planetary geartrain. In some cases, the planetary geartrain can include a modular gear having first teeth that form a sun gear of the planetary geartrain of the reaction gearbox and second teeth that form a ring gear for the input mechanism.

According to yet another aspect of the disclosure, a method of operating a cam phaser is provided. According to the methods, an input torque can be applied to a reaction mechanism via an input mechanism. A first output torque in a first direction can be generated on an engaging member of a cam phaser via one or more planet gears of the reaction mechanism. A second output torque in a second direction, opposite from the first direction, can be generated on a driven member of the cam phaser via a ring gear of the reaction mechanism. The planet gear can be mounted on the engaging member. The driven member can be secured within a portion of the ring gear such that rotation of the ring gear generates corresponding rotation in the driven member The foregoing and other aspects and advantages of the disclosure will appear from the following description. In the description, reference is made to the accompanying drawings which form a part hereof, and in which there is shown by way of illustration a preferred configuration of the disclosure. Such configuration does not necessarily represent the full scope of the disclosure, however, and reference is made therefore to the claims and herein for interpreting the scope of the disclosure.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

DETAILED DESCRIPTION

Figure 1:
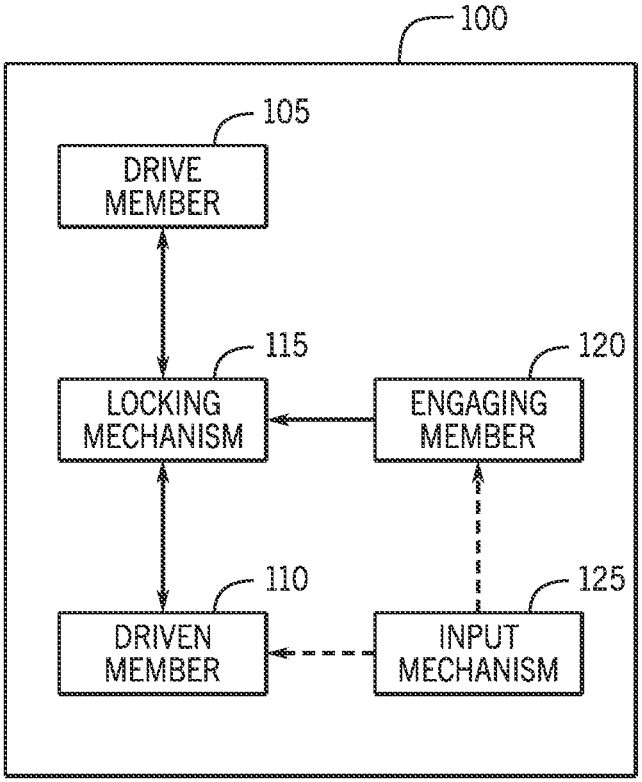
FIG. 1 is a schematic view of a cam phaser according to an aspect of the present disclosure.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Before any embodiments of the invention are explained in detail, it is to be understood that the invention is not limited in its application to the details of construction and the arrangement of components set forth in the following description or illustrated in the following drawings.

The reference numerals in the following description have been organized to aid the reader in quickly identifying the drawings where various components are first shown. In particular, the drawing in which an element first appears is typically indicated by the left-most digit(s) in the corresponding reference number. For example, an element identified by a "cam phaser 100" series reference numeral will likely first appear in FIG. 1, an element identified by a "200" series reference numeral will likely first appear in FIG. 2, and so on.

The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The use herein of the term "axial" and variations thereof refers to a direction that extends generally along an axis of symmetry, a central axis, or an elongate direction of a particular component or system. For example, axially extending features of a component may be features that extend generally along a direction that is parallel to an axis of symmetry or an elongate direction of that component. Similarly, the use herein of the term "radial" and variations thereof refers to directions that are generally perpendicular to a corresponding axial direction. For example, a radially extending structure of a component may generally extend at least partly along a direction that is perpendicular to a longitudinal or central axis of that component. The use herein of the term "circumferential" and variations thereof refers to a direction that extends generally around a circumference of an object or around an axis of symmetry, a central axis or an elongate direction of a particular component or system.

As generally mentioned above, locking mechanisms can be used to control relative movement between a drive member and a driven member in a rotary system (e.g., a cam phasing system). The locking mechanism can move between a locked configuration to rotationally lock the driven member with the drive member, and an unlocked configuration to allow the driven member to rotate relative to the driven member (e.g., to adjust a cam phase angle). Under some operating conditions, it is possible for a locking mechanism to become stuck in the locked configuration. One way of minimizing the risk of the locking mechanism becoming stuck is to allow for a gap between the locking mechanism and at least one of the drive member or the driven member in the unlocked position. However, this typically introduces play into the rotary system, which can introduce unwanted error into the system and make it more difficult to accurately position the drive member and driven member relative to one another (e.g., to achieve a desire cam phase angle). Accordingly, in the context of cam phasing systems, such systems may struggle to achieve balance between maximizing the ability to lock the phaser with minimal slippage while minimizing the torque required to unlock the phaser for shifting the phase angle, and also maximizing overall system and component durability. Aspects of the present disclosure can address these shortcomings by allowing unlocking of the locking member without introducing a gap between the locking member and each of the drive member and the driven member.

For example, a cam phasing system can include a drive member (e.g., a body or sprocket hub configured to couple to a crankshaft) and a driven member (e.g., a cradle rotor configured couple to a camshaft) which can be selectively rotated relative to one another to adjust a phase angle therebetween. A locking mechanism can be positioned between the drive member and the driven member to selectively control a magnitude and direction of relative rotation between the drive member and the driven member (e.g., by selective locking and unlocking of the locking mechanism).

The locking mechanism can by operated by an input mechanism (e.g., an actuator) via a reaction mechanism. The reaction mechanism can be configured to transmit an input torque from the input mechanism to the driven member and an engagement member that is configured to lock and unlock the locking mechanism. More specifically, with the locking mechanism in a locked state with the locking mechanism loaded (e.g., fully compressed) between the drive member and the driven member), the reaction mechanism can transmit a first torque (e.g., a first output torque) to the driven member to unload the locking mechanism by reducing the compressive forces on the locking mechanism. In the unloaded state, some compressive forces may remain on the locking mechanism to provide for a zero-backlash between the drive member and the driven member. Correspondingly, the reaction mechanism can transmit a second torque (e.g., a second output torque) to the engagement member to unlock the locking mechanism and allow for relative rotation between the drive member and the driven member. It is appreciated that first torque is such that the locking mechanism is unloaded to allow the engagement member to overcome any remnant forces on the locking mechanism and move a locking element of the locking mechanism to an unlocked position upon application of the second torque. The first torque and the second torque can be applied in opposing rotational directions.

In some cases, a speed matching gearbox can be provided between the input mechanism and the reaction mechanism. It is appreciated that the reaction mechanism can be arranged in various ways in accordance with the above principles. In one particular example, a reaction mechanism can be configured as a reaction gearbox. The reaction gearbox can a planetary geartrain with a sun gear, a planet carrier, and a ring gear. The sun gear can be coupled to receive an input torque from the input mechanism. Where a speed matching gearbox is provided, the reaction gearbox can include a modular gear forming both the sun gear of the reaction gearbox and an output gear (e.g., a ring gear) of the speed matching gearbox. The planet carrier can be coupled to the engagement member. The ring gear can be coupled to the driven member so that the ring gear and driven member are rotationally locked with one another. In other non-limiting examples, the reaction mechanism can be formed differently.

FIG. 1 illustrates a non-limiting example of a cam phaser 100 according to one example of the present disclosure. The cam phaser 100 may include a drive member 105 and a driven member 110 selectively rotationally coupled by a locking mechanism 115. In some non-limiting examples, the drive member 105 may be coupled to a device that is configured to input energy thereto, such that the drive member 105 travels in unison with the device. For example, the drive member 105 may be coupled to first rotational component, for example, a crankshaft of an engine (e.g., an internal combustion engine), for rotation therewith. The driven member 110 may be coupled to another second rotational component, e.g., a camshaft of the motor, but may be allowed to displace with and/or relative to the drive member 105 (e.g., modify an angle and/or phase with respect to the crankshaft).

Generally, the locking mechanism 115 may be arranged between the drive member 105 and the driven member 110. The locking mechanism 115 may selectively allow relative motion between the drive member 105 and the driven member 110. In one example, the locking mechanism 115 may be movable between a locked position and an unlocked position. In the unlocked position, the locking mechanism 115 may allow the driven member 110 to displace a relative to the drive member 105. That is, the driven member 110 can rotate relative to the drive member 105, up to predetermined limits (e.g., +/−30 degrees). In the locked state, the locking mechanism 115 may prevent relative motion between the drive member 105 and the driven member 110. That is, in the locked state the drive member 105 and the driven member 110 can be rotationally locked to rotate in unison with one another.

In some non-limiting examples, an engaging member 120 may be in selective engagement with the locking mechanism 115 and may be movable independent of or relative to the drive member 105 and the driven member 110. For example, the engaging member 120 may be selectively movable in response to an input force applied by an input mechanism 125 (e.g., an actuator and/or planetary geartrain) coupled to the engaging member 120. The engaging member 120 may be selectively displaced (e.g., via the input mechanism 125) and, in response, the engaging member 120 may engage and displace the locking mechanism 115 in a desired direction (e.g., clockwise or anti-clockwise) to transition the locking mechanism 115 between the locked position and the unlocked position. Displacement of the locking mechanism 115 in either direction can result in the driven member 110 rotating relative to the drive member 105 in a corresponding direction (e.g., clockwise or anti-clockwise)

In operation, the driven member 110 may be subjected to an outside force (e.g., a first force or torque) that applies a load onto the locking mechanism 115. For example, the device to which the driven member 110 is coupled may exert a force on the driven member 110. In some non-limiting examples, the force may occur in more than one direction. In some non-limiting examples, the force may be cyclically applied to the driven member 110 with an alternating direction and variable magnitude.

In some non-limiting examples, when the force is exerted on the driven member 110, the corresponding load applied to the locking mechanism 115 can compress the locking mechanism 115 between the drive member 105 and the driven member 110. This compression applied to the locking mechanism 115 may substantially prevent the locking mechanism 115 from being transitioned, for example, by the engaging member 120 between the locked and unlocked positions. That is, the compression of the locking mechanism 115 between the drive member 105 and the driven member 110 can effectively "lock" the locking mechanism 115 and substantially prevent the engaging member 120 from selectively displacing the locking mechanism 115. Thus, for certain operating conditions, the force applied to the driven member 110 may place the locking mechanism 115 in a loaded state in which the engaging member 120 is substantially prevented from selectively displacing the locking mechanism 115 and transitioning the locking mechanism 115 between the locked and unlocked positions. When the locking mechanism is in the locked position, the drive member 105 and the driven member 110 can be rotationally locked with one another to rotate at in unison (i.e., at the same rotational speed).

In some non-limiting examples, the locking mechanism can be unloaded and unlocked to allow the drive member 105 and the driven member 110 to rotate relative to one another. That is, the compression of the locking mechanism 115 resulting from the force on the driven member 110 may be released (e.g., the compression of the locking mechanism 115 may be mitigated) by applying an input force to the driven member 110. Thus, the input mechanism 125 may be coupled to the driven member 110 such that the input mechanism 125 may selectively apply an additional force to the driven member 110 (e.g., a second, input force or torque in addition to first force applied to the driven member 110 via the motor), to unload the locking mechanism 115 and unlock movement of the locking mechanism 115. For example, following the unloading of the locking mechanism 115 via the input mechanism 125, the input mechanism 125 may then actuate (e.g., rotate) the engaging member 120 to apply a force to the locking mechanism 115 to unlock it and enable adjustment of the driven member 110 relative to the drive member 105. Accordingly, in the unloaded state, the locking mechanism 115 can be unlocked to allow the drive member 105 and the driven member 110 to rotate relative to one another (e.g., at different rotational speeds). The force provided by the input mechanism can control the magnitude of the difference between the rotational speeds and/or positions of the drive member 105 and the driven member 110.

It is appreciated that, in the unloaded state, the locking mechanism 115 can remain in contact with both the drive member 105 and the driven member 110 to reduce play in the system. Accordingly, the in the unloaded state, the compressive forces between the locking mechanism 115 and the drive member 105 and the driven member 110 can be substantially removed, as compared with the compressive forces present in the loaded state. For example, when unloaded, the compressive force on the locking mechanism 115 can be reduced to be less than about 50%, less than about 25%, less than about 10%, less than about 5%, or less than about 2% of the compressive force present in the loaded state.

In some non-limiting examples, the cam phaser 100 may be applied in a mechanical cam phasing application. For example, the drive member 105 may be rotatably coupled to a crankshaft of an internal combustion engine, and the driven member 110 may be rotatably coupled to a camshaft of an internal combustion engine. In some non-limiting examples, the engaging member 120 may be coupled to the input mechanism 125 (e.g., actuator and/or planetary geartrain), which is configured to provide an input force to the engaging member 120. In some non-limiting examples, the input mechanism 125 may be configured to apply the input force to the engaging member 120 to displace the engaging member 120 into the locking mechanism 115 by a predetermined amount and/or distance to unlock rotation of the driven member 110 relative to the drive member 105. The resulting displacement of the locking mechanism 115 may allow the driven member 110 to rotate relative to the drive member 105 (i.e., the camshaft may selectively rotate relative to the crankshaft) in a desired direction to achieve a desired amount of cam phasing (i.e., a rotational offset between the camshaft and the crankshaft).

Figure 2:
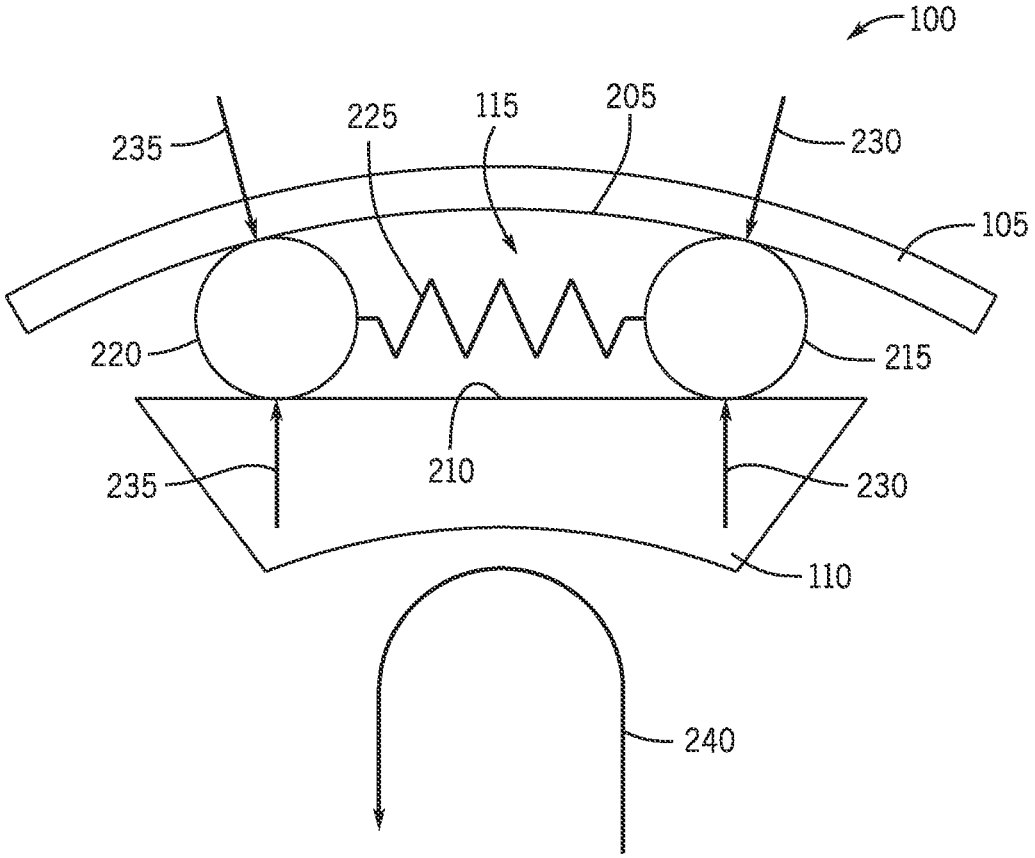
FIG. 2 is a schematic view of a portion of the cam phaser of FIG. 1 in a loaded state.
Figure 3:
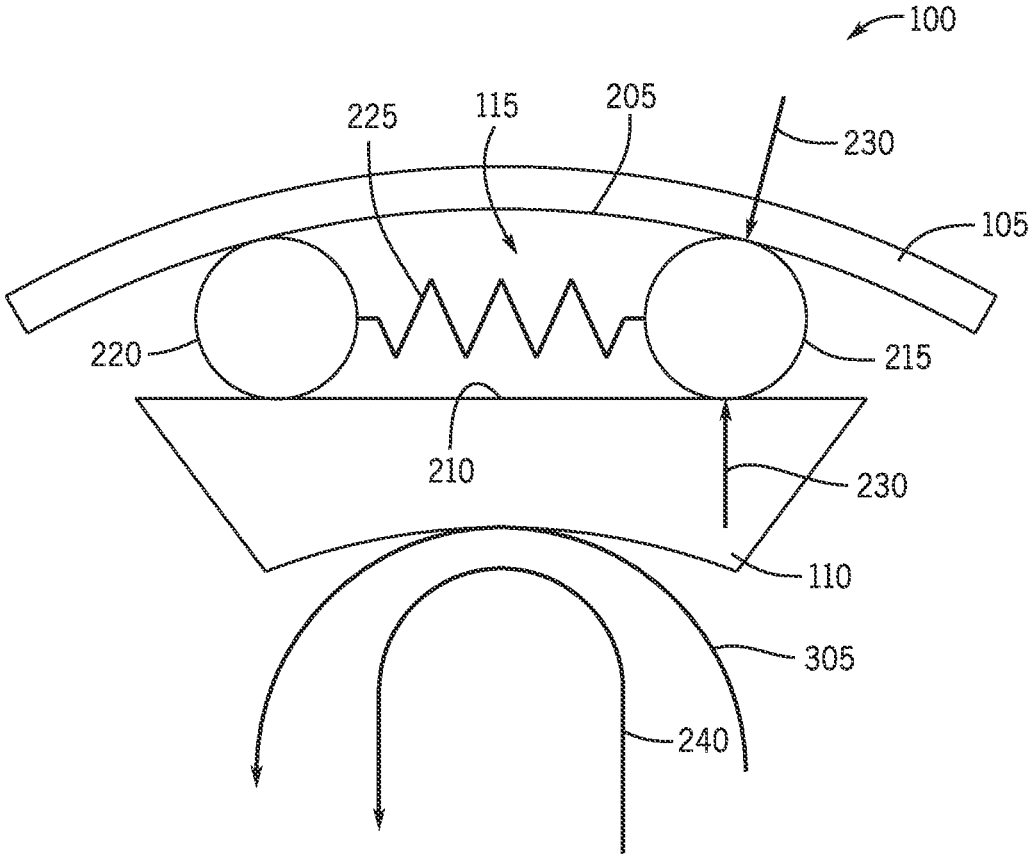
FIG. 3 is a schematic view of a portion of the cam phaser of FIG. 2 in an unloaded state.

In the examples illustrated in FIGS. 2 and 3, the drive member 105 can include a first mating surface 205 arranged adjacent to the locking mechanism 115. The driven member 110 can include a second mating surface 210 arranged adjacent to an opposite side of the locking mechanism 115. In the illustrated non-limiting example, the locking mechanism 115 may be arranged between the first mating surface 205 and the second mating surface 210. The locking mechanism 115 can include a first locking member 215 and a second locking member 220 biased away from one another via a biasing element 225. In some examples, the biasing element 225 may be in the form of a spring, resilient material, and/or other biasing and/or elastic material. In one particular example, the 225 may be in the form of a coil spring. In some non-limiting examples, the first locking member 215 and second locking member 220 may be in the form of bearing elements. In some non-limiting examples, the first locking member 215 and second locking member 220 may be in the form of roller bearings. In some non-limiting examples, the first locking member 215 and second locking member 220 may take any form configured to conform to a cavity between the first mating surface 205 and the second mating surface 210, or capable of wedging therebetween. In some cases, as plurality of locking mechanisms 115 can be arranged between the drive member 105 and the driven member 110.

One non-limiting example of the operation of the cam phaser 100 in a mechanical cam phasing application will be described with continued reference to FIGS. 2 and 3. Generally, during operation, forces (e.g., cam torque pulses) may be exerted on the driven member 110. For example, the driven member 110 may be subjected to cam torque pulses originating from the intake and exhaust valves acting on the camshaft. The cam torque pulses acting on the driven member 110 may vary in direction and magnitude (e.g., cyclically) during operation of the internal combustion engine. Energy from these torque pulses can be harvested by the cam phaser 100 to cause the drive member 105 and the driven member 110 to rotate relative to one another to adjust a cam phase angle. By selectively locking and unlocking the locking mechanism 115, the driven member 110 can be constrained to rotate in a particular direction relative to the drive member 105 (e.g., to advance and retard cam timing). For example, by unlocking the first locking member, the driven member 110 can rotate in a first direction relative to the drive member to advance the cam timing. Conversely, by unlocking the second locking member 220, the driven member 110 can rotate in an opposite, second direction relative to the drive member 105 to retard cam timing.

More specifically, during operation, a first force may be applied to the cam phaser 100 in a first direction as shown by force 240 (e.g., rotational moment force, torque). In the illustrated non-limiting example, the force may be a torque pulse acting on the driven member 110 in, for example, a counterclockwise direction. When the force is applied to the driven member 110 in the first direction, compressive forces "F" may apply load to the first locking member 215 as shown by force arrows 230. For example, the compressive forces "F" may result from contact between the first locking member 215 and both of the first mating surface 205 and the second mating surface 210. The compressive forces applied to the first locking member 215 as a result of the torque on the driven member 110 may "lock" the first locking member 215, and can result in a temporary, resilient deformation of the first locking member 215 (e.g., due to the material properties of the first locking member 215). As a result, the first locking member 215 may be substantially prevented from being displaced by the engaging member 120, and relative rotation between the drive member 105 and the driven member 110 may be prevented.

However, the second locking member 220, which may previously have been locked similar to the first locking member 215 described above, may remain locked as a result of remainder forces "F rem" applied to the second locking member 220, as shown by force arrow 235. The remainder forces may be a result of the second locking member 220 remaining partially compressed between the drive member 105 and the driven member 110. Such partial compression may result from a lack of sufficient force applied in the direction shown by force arrow 240 (e.g., cam pulse in the counterclockwise direction is less than the cam pulse in the clockwise direction). Thus, both the first locking member 215 and the second locking member 220 may be locked and/or compressed (e.g., in the loaded state) between the first mating surface 205 and the second mating surface 210, which prevents the engaging member 120 from releasing (e.g., unlocking) the second locking member 220 to enable relative movement of the driven member 110 with respect to the drive member 105. It is appreciated that similar principles apply where the torque 240 is applied in the opposite direction (e.g., anti-clockwise in FIGS. 2 and 3) to compress the second locking member 220 and decompress the first locking member 215.

To remove the remainder forces from the second locking member 220, the cam phaser 100 may apply an additional force in the same direction as force 240 (i.e., "T act" as shown by force arrow 305). The additional force Tact may be generated on the driven member 110 via the input mechanism 125 (e.g., actuator/planetary geartrain). For example, the input mechanism 125 may transmit force from an actuator through a series of gear sets (e.g., planetary gear sets), which can multiply the force applied by the actuator (e.g., from 2-10 times greater) to further compress the first locking member 215. In turn, the rotational movement of the driven member 110 causes the second mating surface 210 to cant, angle, or otherwise move away from the second locking member 220 at the point of contact with the second locking member 220 (e.g., due to the shape of the second mating surface 210), such that second locking member 220 can further decompress, and such that the remainder forces are substantially removed from the second locking member 220. Thus, the second locking member 220 is now said to be in an unloaded state and is able to be "unlocked" by the engaging member 120 to enable relative movement of the driven member 110 with respect to the drive member 105. As generally mentioned above, it is appreciated, that the remainder forces may only be partially removed to allow the force from the engaging member 120 to overcome the remainder forces. Accordingly, even when being unlocked, the second locking member 220 can be partially compressed between the drive member 105 and the driven member 110. In this way, the second locking member 220 remains in contact with both the drive member 105 and the driven member 110, thereby reducing play in the system.

Figure 4:
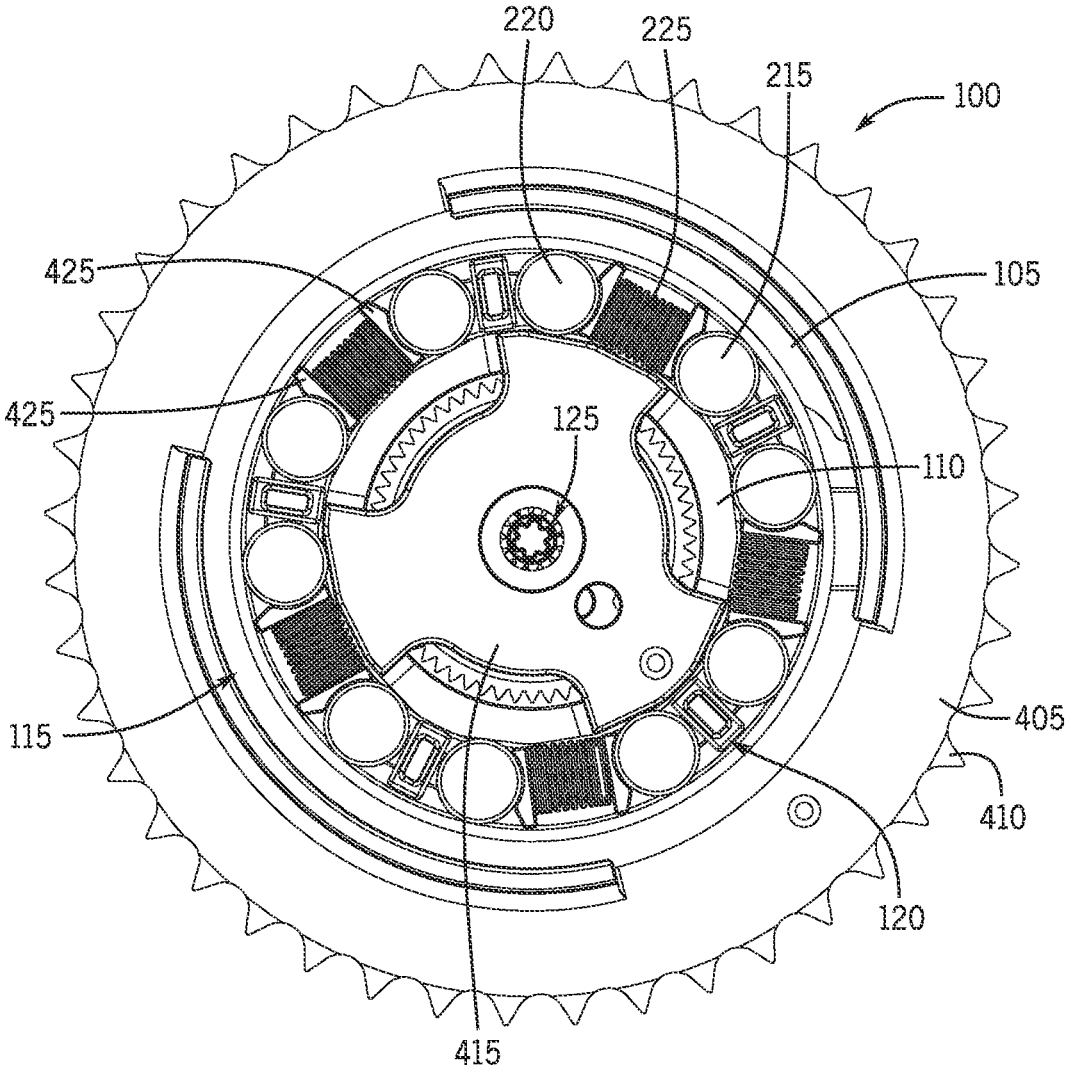
FIG. 4 is a top view of a portion of the cam phaser of FIG. 1 with an endcap removed.
Figure 5:
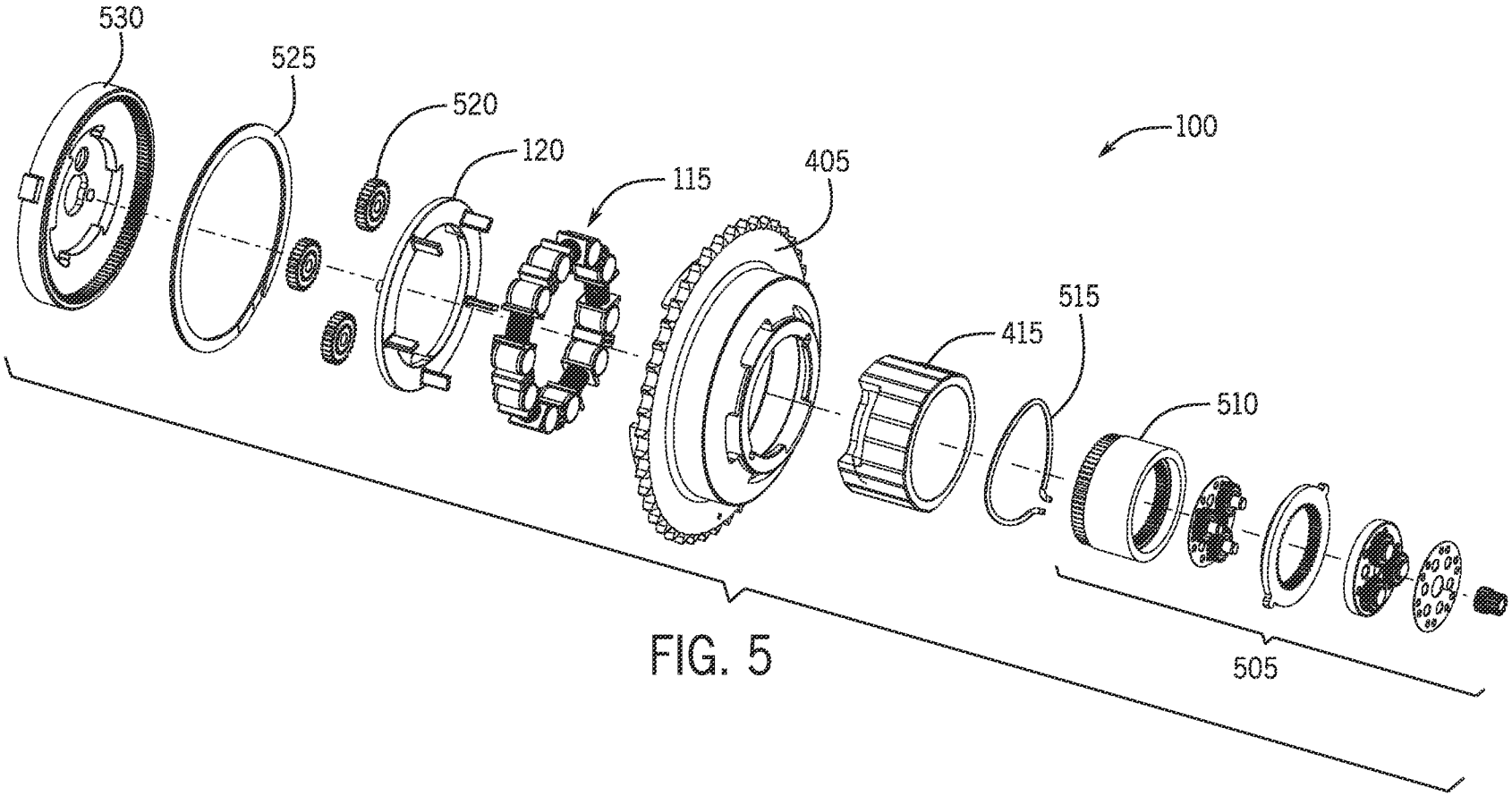
FIG. 5 is front exploded view of the cam phaser of FIG. 1.
Figure 6:
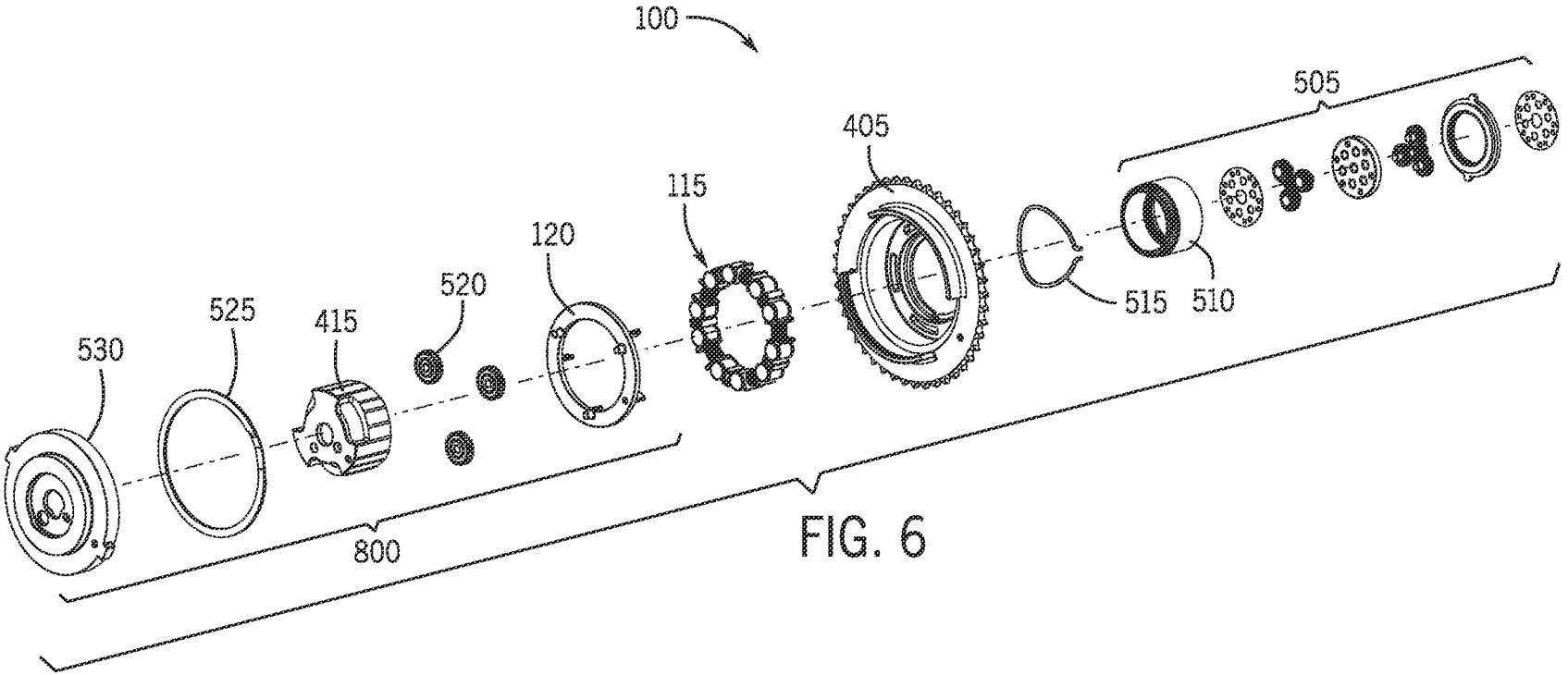
FIG. 6 is a rear exploded view of the cam phaser of FIG. 1.
Figure 7:
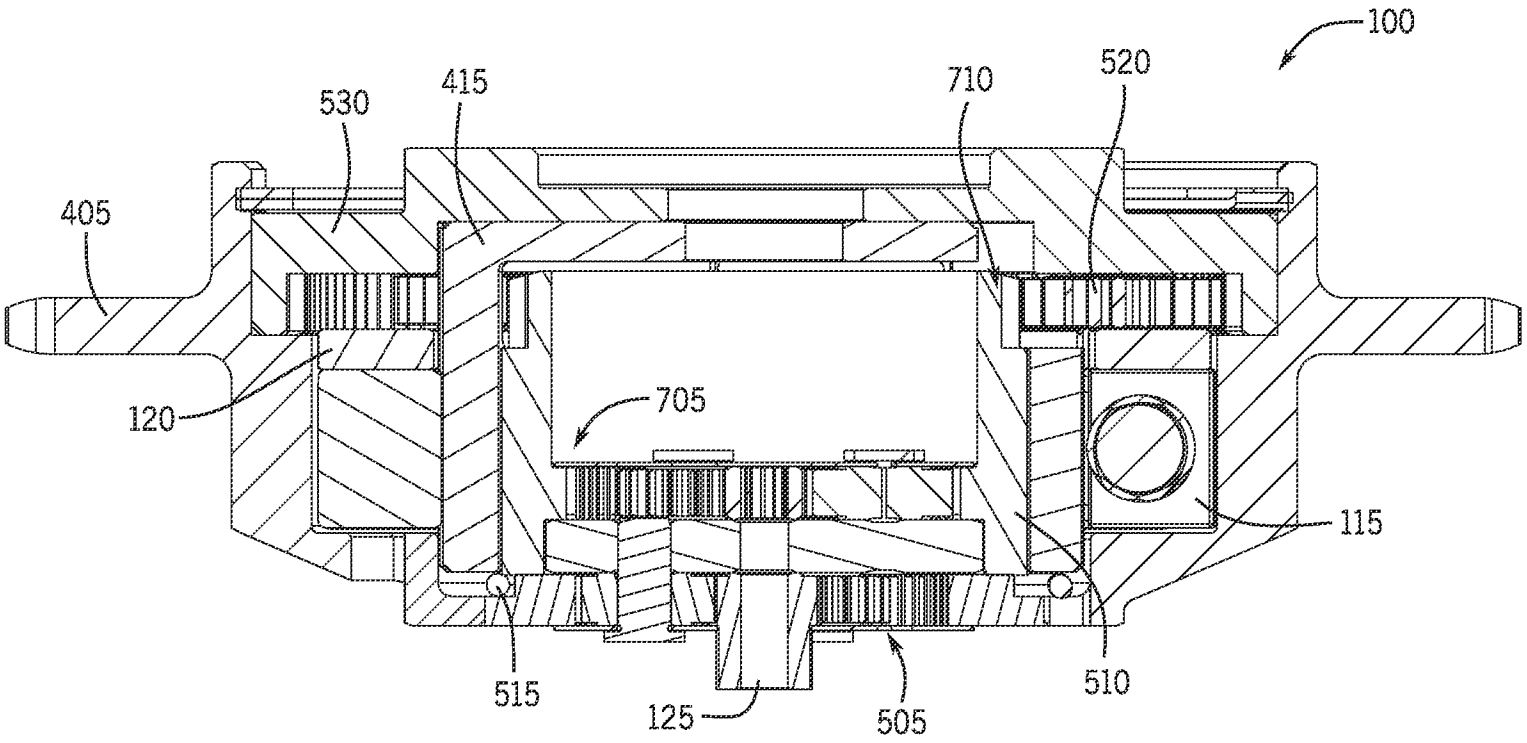
FIG. 7 is a cross-sectional view of the cam phaser of FIG. 1.

FIG. 4 shows an example of the cam phaser 100. The cam phaser 100 may include a body 405 (e.g., a sprocket hub) defining a sprocket 410 on an exterior surface. In one example, the sprocket 410 may be configured to interact with a chain, pulley, gear, and/or other device. In one particular example, the sprocket 410 may be configured to engage with a timing chain of a vehicle in order to mechanically link the cam phaser 100 to a crankshaft of the vehicle. In one example, a portion of the body 405 of the cam phaser 100 may define the drive member 105 while a portion of a cradle rotor 415 may define the driven member 110. In one particular example, the cradle rotor 415 may be mechanically connected to the camshaft to enable relative movement of the camshaft. Correspondingly, the locking mechanism 115 may be sandwiched between the cradle rotor 415 and a body 405 of the cam phaser 100.

As shown in FIG. 4, the first locking member 215 and the second locking member 220 are bounded and/or maintained in position within the cam phaser 100 via one or more retention fittings 425 (e.g., locking feature supports). In one example, the retention fittings 425 may further be configured to serve as a mounting location for each end of the biasing element 225. Thus, the biasing element 225 may apply an outward biasing force to the first and second locking members 215, 220 through the retention fittings 425. As should be appreciated, the biasing element 225 is configured to bias the first and second locking members 215, 220 outward into contact with the driven member 110 and the drive member 105 to avoid unwanted gaps and/or play in the cam phaser 100.

FIGS. 5-8 show various different views of the cam phaser 100 illustrating components of the cam phaser 100. For example, the cam phaser 100 may include a speed matching gearbox 505, forming a portion of the input mechanism 125, having one or more planetary geartrains, for example, as described in U.S. patent application Ser. No. 17/608,442, entitled "Systems and Methods for Controlled Relative Rotational Motion," which is incorporated herein by reference in its entirety. The speed matching gearbox 505 can transfer an input force from the input mechanism 125 to a reaction mechanism that is configured to rotate the driven member 110 to control loading and unloading of the locking mechanism 115, and to rotate the engagement member 120 to control locking and unlocking of the locking mechanism 115. It is appreciated that reaction mechanisms can be configured in different ways. In one example, a reaction mechanism can be configured as a reaction gearbox 800. More specifically, the reaction gearbox 800 can be configured as a planetary gearbox. Correspondingly, the cam phaser 100 may include a modular gear 510, which serves as both the ring gear of the speed matching gearbox 505 and the sun gear of a reaction gearbox 800 (shown in FIG. 8). In some cases, a modular gear can include a first portion defining the ring gear of a speed matching gearbox and a separate second portion defining the sun gear of a reaction gearbox, which can be coupled with one another.

In one example (shown in FIG. 7), one or more planet gears of the speed matching gearbox 505 may mesh and/or interact with an inner teeth 705 of the modular gear 510 and one or more planet gears 520 of the reaction gearbox 800 may mesh and/or interact with an outer teeth 710 of the modular gear 510. Thus, rotation generated in the speed matching gearbox 505 via an actuator (e.g., electric, pneumatic, hydraulic, mechanical and/or other actuator) may likewise impart rotation to the reaction gearbox 800 via the modular gear 510. In one example, the reaction gearbox 800 is configured to apply a torque and/or force to the cradle rotor 415, which defines the driven member 110. Thus, the torque applied to the cradle rotor 415 allows the transition of the first and second locking members 215, 220 from the loaded to the unloaded states.

In one example, a retention clip 515 can be positioned between the speed matching gearbox 505 (e.g., the modular gear 510) and the body 405 to couple the speed matching gearbox 505 to the cam phaser 100 and prevent axial movement therein. Additionally, a snap ring 525 (shown in FIG. 5) may be positioned between the ring gear 530 (e.g., end cap) and the body 405 of the cam phaser 100 to secure the ring gear 530 to the cam phaser 100.

Figure 8:
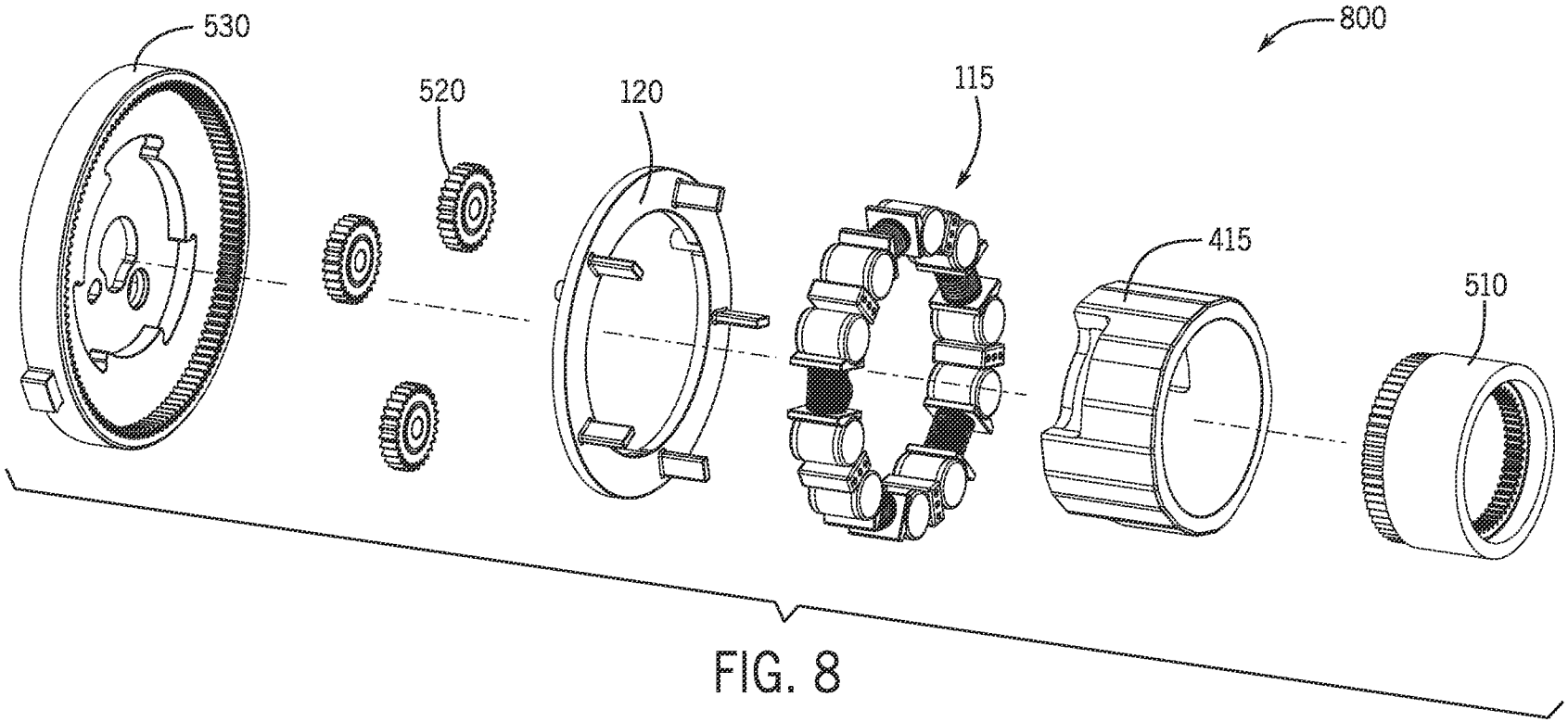
FIG. 8 is an exploded view of a reaction gearbox of the cam phaser of FIG. 1.

As shown in FIG. 8, the reaction gearbox 800 may be in the form of a planetary geartrain including the modular gear 510, the cradle rotor 415, the locking mechanism 115, the engaging member 120, one or more planet gears 520, and the ring gear 530. In one example, the reaction gearbox 800 is configured to receive an input from the input mechanism 125 (e.g., actuator and/or the speed matching gearbox 505). The input may generate rotation of the modular gear 510, which in turn generates rotation in the planet gears 520 and the engagement member 120 (i.e., a spider rotor that acts as the planet carrier of the planet gears 520), which increases the torque applied to the first and/or second locking members 215 and 220 via the engagement member 120. Since the planet gears 520 mesh with the ring gear 530 (i.e., endcap), a corresponding rotation of the ring gear 530 can be accomplished at an increased torque value (e.g., 2-10× input torque). In other cases, the rotation of the ring gear 530 can be accomplished at a different torque value, for example, equal to or less than the input torque. Thus, since the cradle rotor 415 (e.g., driven member 110) is coupled to the ring gear 530, an additional torque is applied to the cradle rotor 415, which may transition the first and/or second locking members 215, 220 from the loaded to the unloaded state (e.g., to lock and unlock the locking mechanism 115). Concurrently, in some cases, the body 405 can provide a resistive force on a respective locking member 215 220 that is being unlocked, allowing the remaining forces on that locking member to be unloaded. In turn, the engagement member 120 may then selectively actuate the locking mechanism 115 from the locked to the unlocked state to enable relative rotation of the cradle rotor 415 and thus the camshaft.

Figure 9:
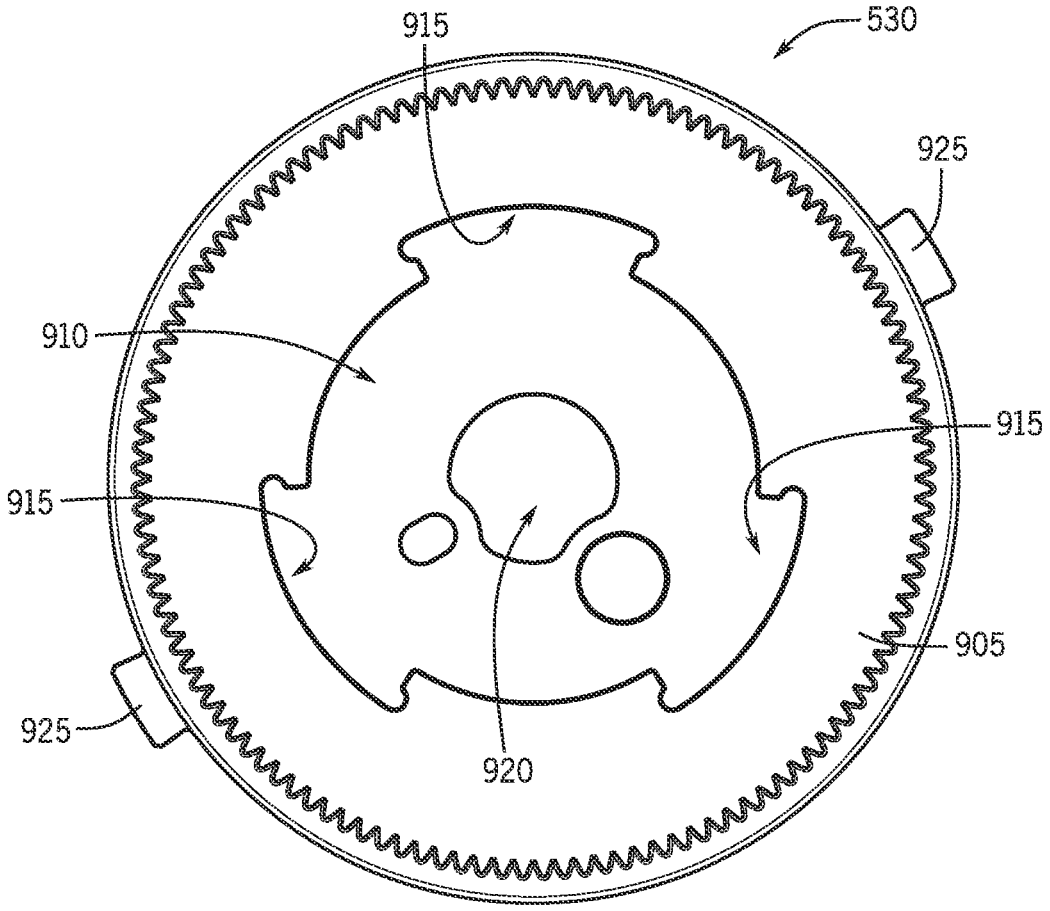
FIG. 9 is a top view of the endcap of the cam phaser of FIG. 1.

As illustrated in FIG. 9, the ring gear 530 may be in the form of an end cap 905 of the cam phaser 100. The end cap 905 may define a cutout 910 configured to secure the cradle rotor 415. In one example, the cutout 910 includes a series of locking apertures 915 configured to rotationally lock the cradle rotor 415 to the end cap 905. Correspondingly, the cradle rotor 415 is configured to lock into the end cap 905 such that the cradle rotor 415 rotates along with the ring gear 530. In one example, the cradle rotor 415 (shown in FIGS. 11 and 12) includes a body 1105 and a base 1110. The base 1110 includes one or more protruding lobes 1115 configured to interlock and/or correspond to the locking apertures 915 of the ring gear 530 to enable the cradle rotor 415 to lock into the ring gear 530. In one example, the end cap 905 may include an aperture 920 corresponding to a mounting hole 1125 of the cradle rotor 415. The aperture 920 may be configured to enable a portion of a camshaft and/or other component to connect to the cam phaser 100. For example, a fastener can be inserted through the mounting hole 1125 and the aperture 920 to engage with and transmit torque to a camshaft. It is appreciated the force from the fastener can also rotationally secure the cradle rotor 415 to the end cap 905

Figure 10:
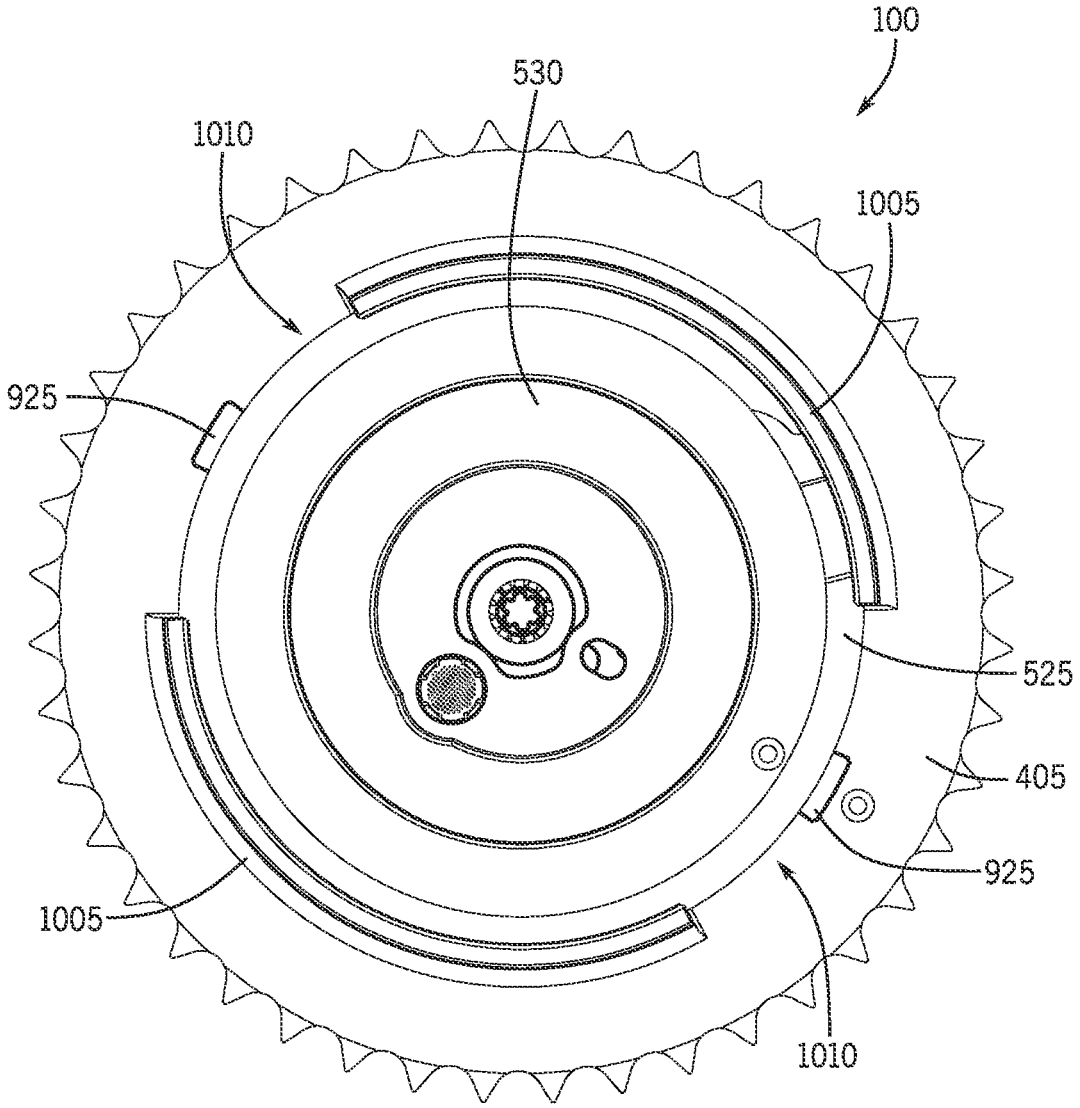
FIG. 10 is a top view of the cam phaser of FIG. 1.

As shown in FIG. 10, the end cap 905 includes one or more tabs 925 protruding from an exterior circumference of the end cap 905. The tabs 925 may be configured to prohibit over-rotation of the ring gear 530 beyond a predetermined rotational degree. For example, the one or more tabs 925 may be configured to move within a channels 1010 defined by a pair of ridges 1005 of the body 405 of the cam phaser 100. In one example, as the ring gear 530 rotates, the tabs 925 approach the ends of the ridges 1005. Once the tabs 925 contact the ridges 1005, the ring gear 530 is prohibited from further rotation in the same direction (i.e., rotation in the opposite direction is allowed). Thus, at this stage, the ring gear 530 is locked from further rotation in the same direction.

Figure 11:
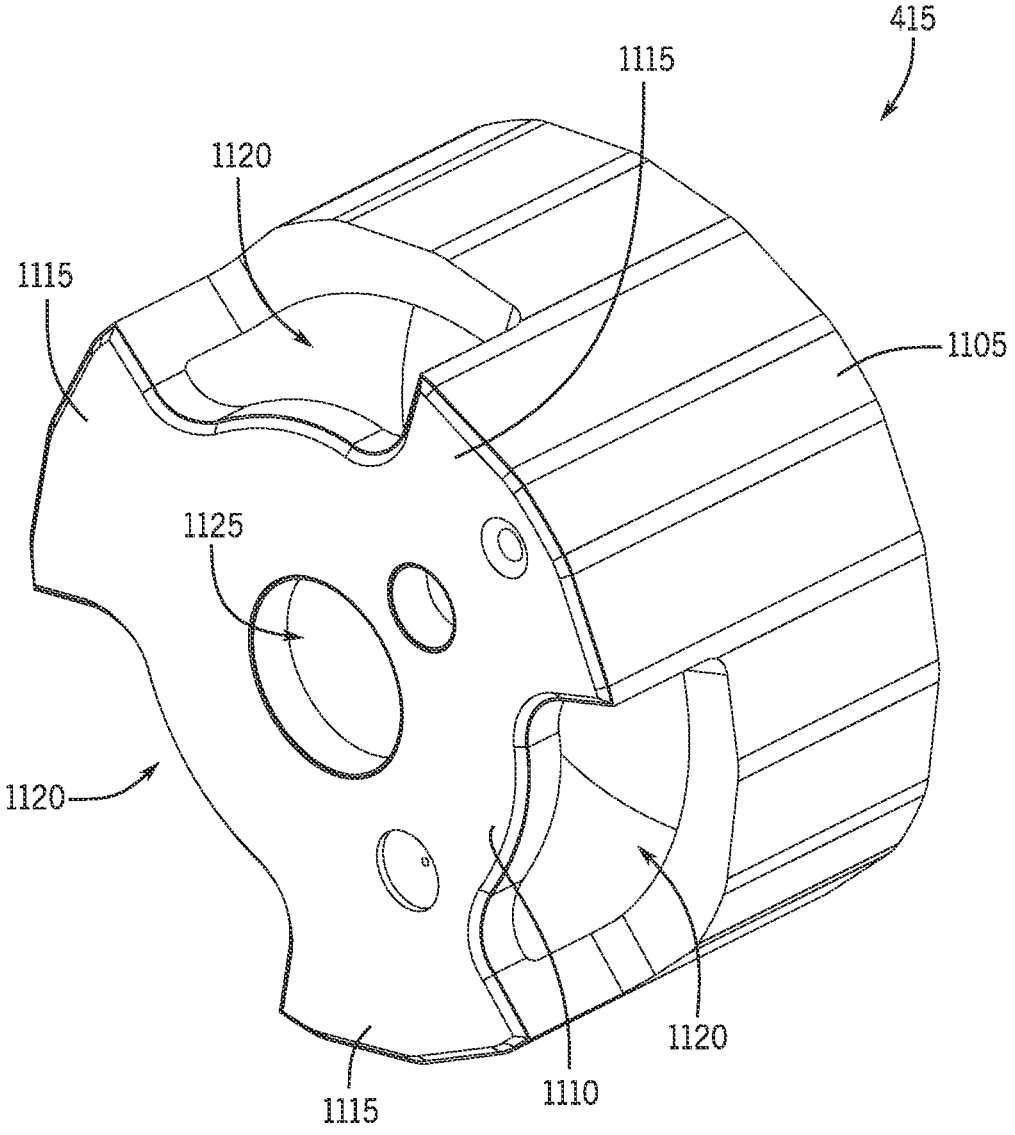
FIG. 11 is a perspective view of a cradle rotor of the cam phaser of FIG. 1.
Figure 12:
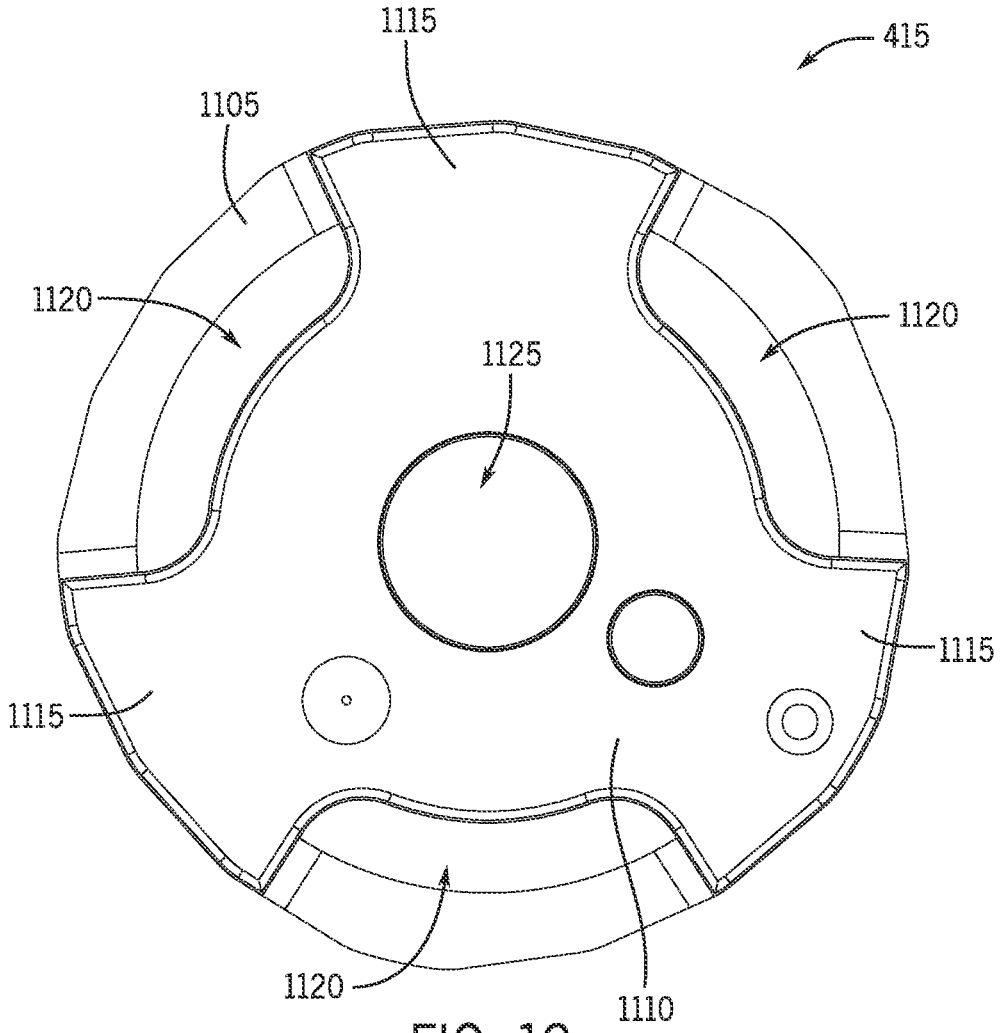
FIG. 12 is a bottom view of the cradle rotor of the cam phaser of FIG. 1.

FIGS. 11 and 12 show an example of the cradle rotor 415. As described previously, the cradle rotor 415 includes the body 1105 and the base 1110, which together define one or more cutouts 1120 configured to enable the one or more planet gears 520 to protrude through the cradle rotor 415 and mesh with the modular gear 510 to generate rotation of the cradle rotor 415. In one example, the body 1105 of the cradle rotor 415 defines the driven member 110 of the cam phaser 100. In another example, the reaction gearbox 800 may be designed such that the modular gear 510 is configured to nest within the cradle rotor 415 to reduce the overall footprint of the cam phaser 100 (e.g., an axial or radial dimension thereof). As described previously, the base 1110 of the cradle rotor 415 defines a mounting hole 1125, which may receive fastener configured to couple a camshaft of the vehicle and connect the cam phaser 100 and the camshaft. Thus, rotation of the cradle rotor 415 may directly correspond to rotation of the camshaft.

Figure 13:
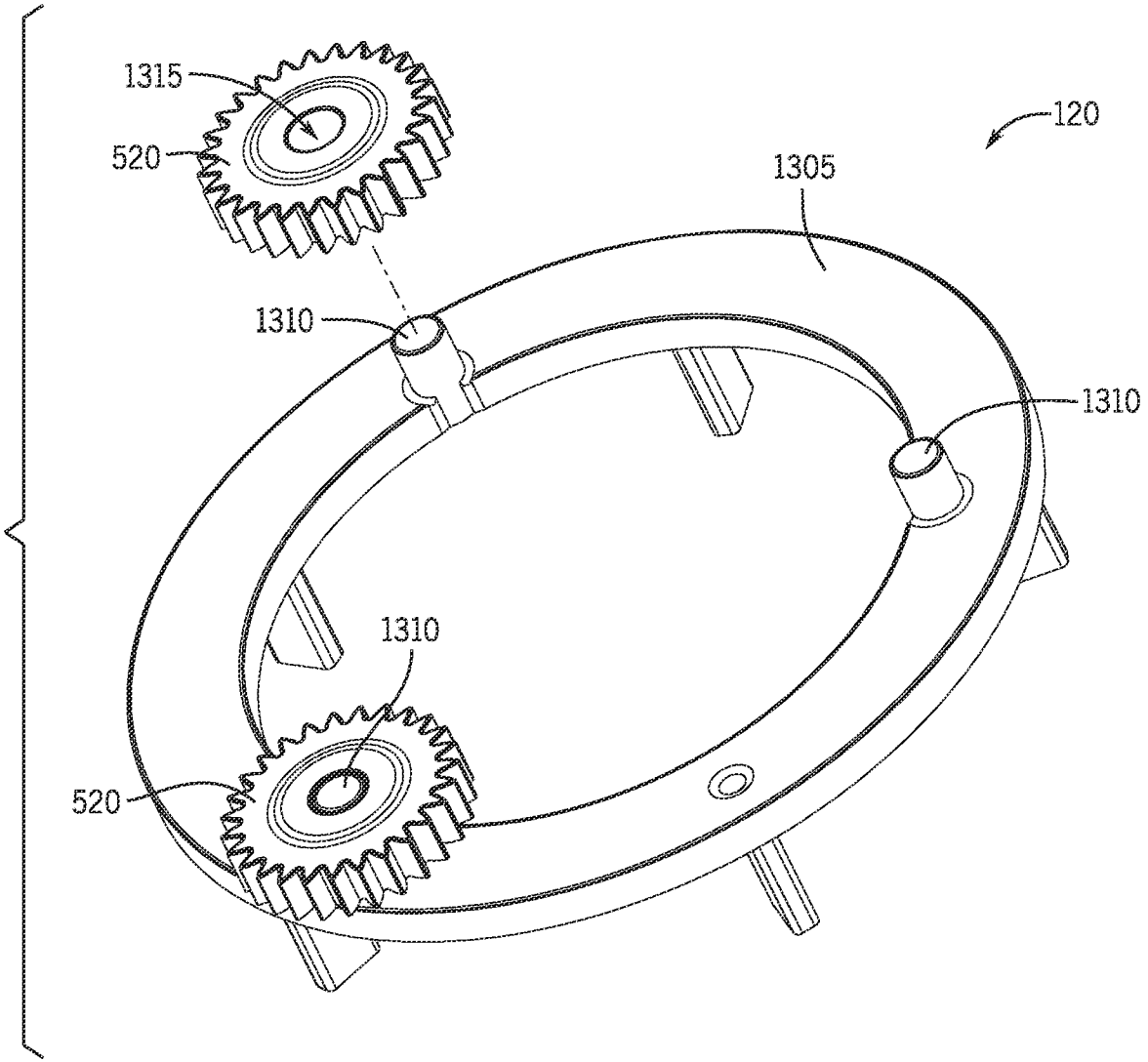
FIG. 13 is a bottom perspective view of an engaging member of the cam phaser of FIG. 1.
Figure 14:
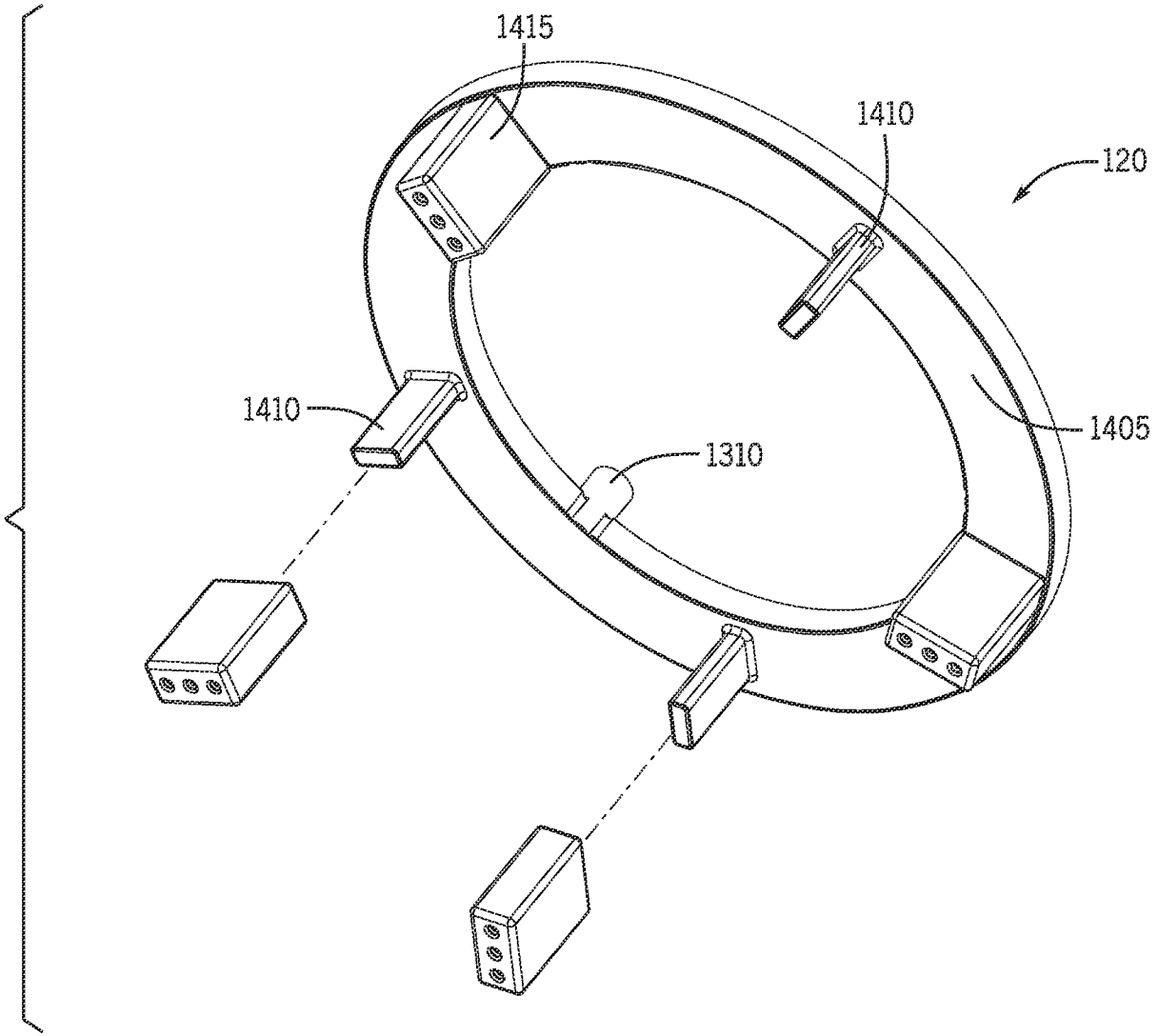
FIG. 14 is a top perspective view of the engaging member of the cam phaser of FIG. 1.
Figure 15:
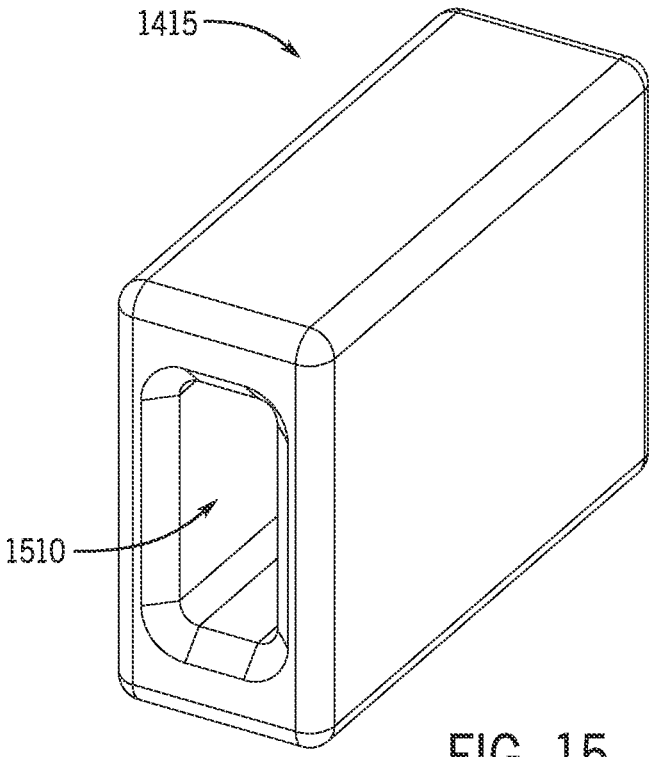
FIG. 15 is a perspective view of an engagement sleeve for use with the engaging member of FIG. 14.

FIGS. 13-15 show examples of the engaging member 120. In one example, the engaging member 120 may define an annular ring shape with a second surface 1305 including one or more posts 1310. The posts 1310 may be configured to receive the one or more planet gears 520 via an aperture 1315 of the planet gears 520 such that the engaging member 120 acts as a planet carrier for the reaction gearbox 800. Put differently, the engaging member 120 may act as both the engaging member (i.e., to actuate the first and second locking members 215, 220) and as the planet carrier for the planetary geartrain of the reaction gearbox 800. Thus, the overall size of the cam phaser 100 may be reduced.

To that end, the engaging member 120 may further include a first surface 1405 including one or more tabs 1410 configured to engage with the locking mechanism 115 for locking and unlocking. In some cases, the tabs 1410 may be optionally configured to each receive a sleeve 1415, which can account for sizing tolerances in manufacturing. In one example, the sleeves 1415 may define an opening 1510 and may be configured to surround the tabs 1410 when the tabs 1410 are positioned within the opening 1510 (i.e., the tabs 1410 protrudes into the sleeves 1415 via the opening 1510). In one example, the engaging member 120 is configured to contact the first locking member 215 and/or the second locking member 220 of the locking mechanism 115 via the one or more tabs 1410 (i.e., via optional sleeves 1415) to unlock the locking mechanism 115. For example, the tabs 1410 can apply a force to the first and/or second locking members 215, 220 of the locking mechanism 115 to unlock the locking mechanism 115. As mentioned previously, the engaging member 120 may be moved via the planetary gear train of the reaction gearbox 800. Additionally, an additional force or torque may be generated in the engaging member 120 when an input is received via the input mechanism 125.

Figure 16:
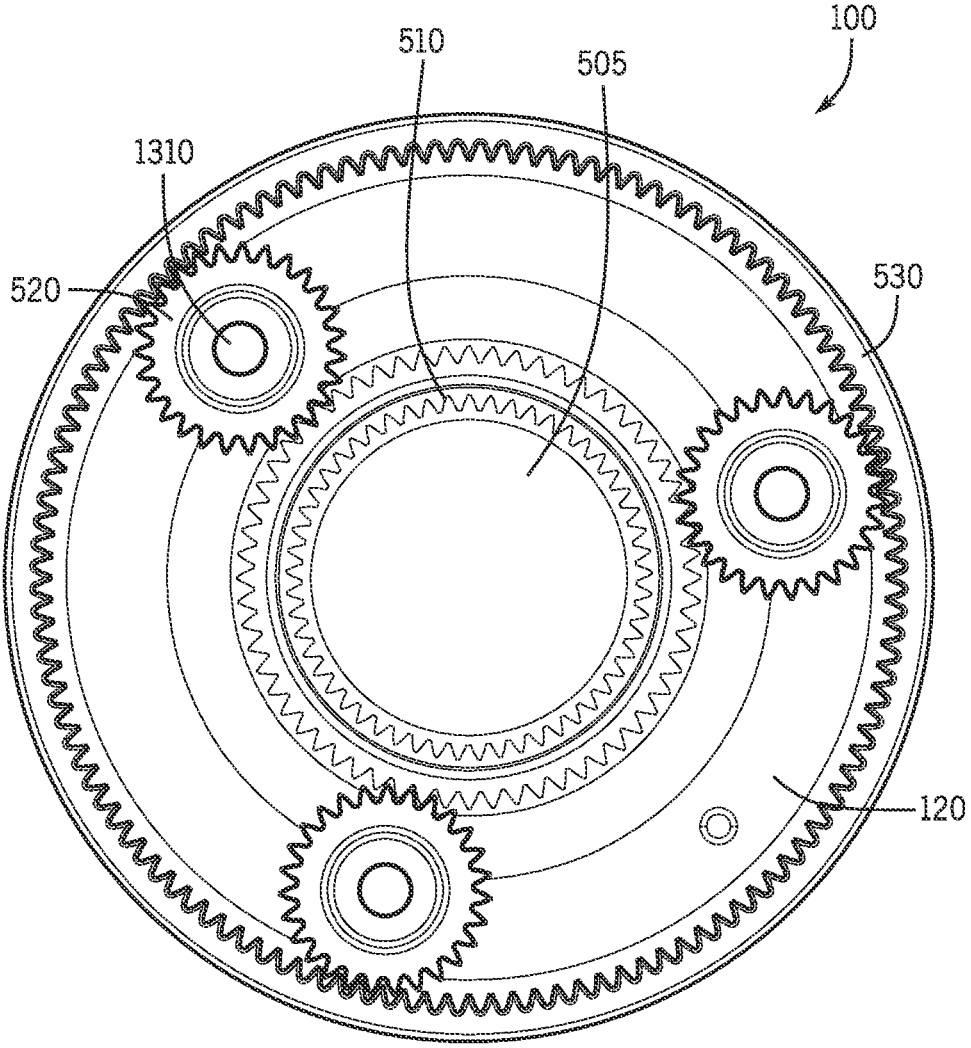
FIG. 16 is a cross-sectional view of the cam phaser of FIG. 1.

FIG. 16 shows an example of the cam phaser 100 in use. In one example, the input mechanism 125 transmits an input to the modular gear 510. Put differently, an actuator applies a force to the speed matching gearbox 505, which functions to generate rotation in a first direction in the modular gear 510. As the modular gear 510 has both interior and exterior teeth (e.g., to function as ring gear for speed matching gearbox 505 and sun gear for reaction gearbox 800), the modular gear rotates the planet gears 520, which drive rotation of the ring gear 530. Thus, an additional input force may be generated in the ring gear 530, which is transmitted to the cradle rotor 415 to unload a portion of the locking mechanism 115 and enable the engaging member 120 to unlock the locking mechanism 115. Thus, the engaging member 120 is able to unlock relative rotation of the cradle rotor 415 and the camshaft.

In one example, the direction of the torque generated in the ring gear 530 is opposite of the direction of rotation of desired phasing of the camshaft. For example, if the camshaft is desired to phase clockwise, the ring gear 530 is configured to rotate counterclockwise and vice versa. In other examples, the torque generated in the ring gear 530 may be in the same direction of the rotation of desired phasing of the camshaft.

Figure 17:
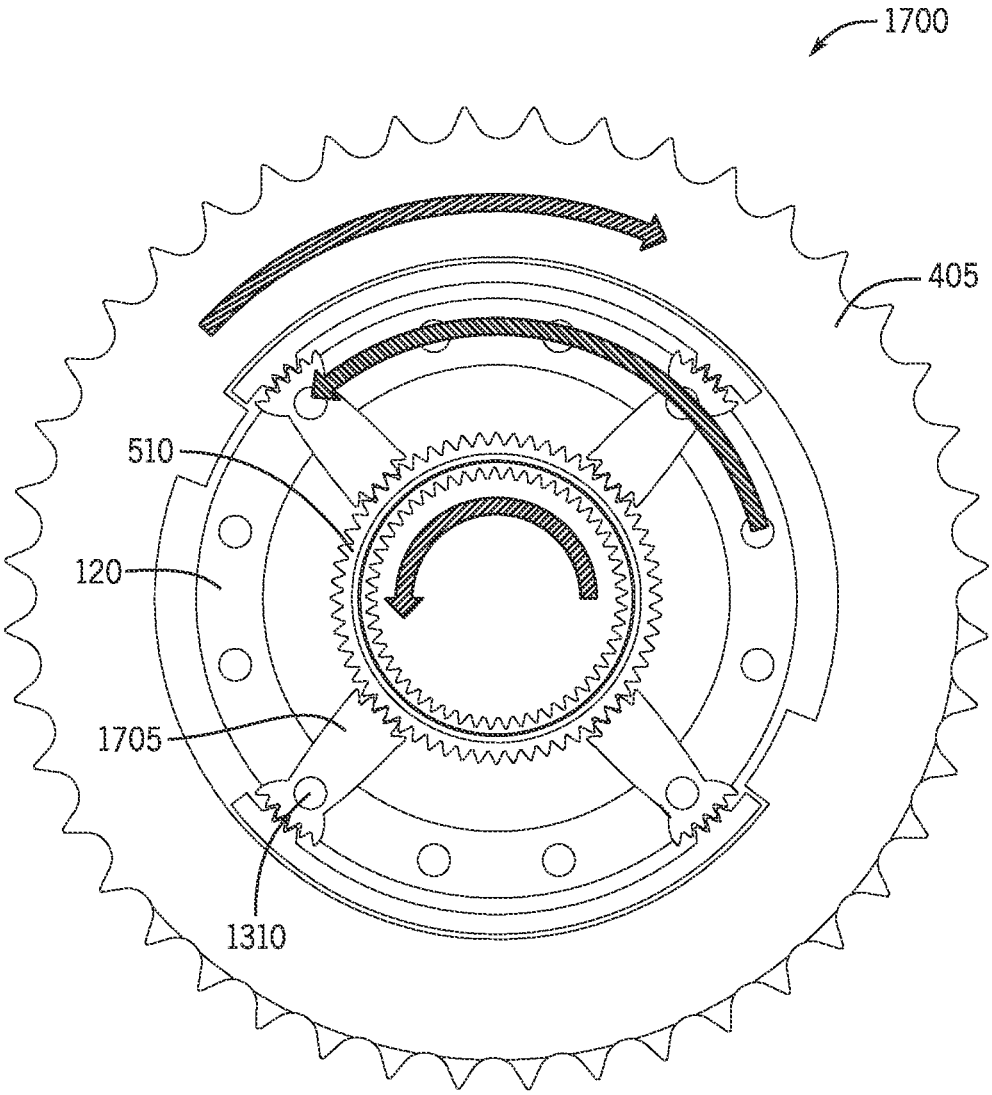
FIG. 17 is a perspective view of a portion of another example of a cam phaser according to another aspect of the present disclosure.

FIG. 17 illustrates another example of a cam phaser 1700. As will be recognized, the cam phaser 1700 shares a number of components in common with and operates in a similar fashion to the examples illustrated and described previously. For the sake of brevity, these common features will not be again described below in detail. Rather, previous discussion of commonly named or numbered features, unless otherwise indicated, also applies to example configurations of the cam phaser cam phaser 1700.

The cam phaser 1700 may include a reaction mechanism (i.e., reaction gearbox) with one or more pivot gears 1705 in lieu of the planet gears 520 described previously. The pivot gears 1705 may be configured to enable only a predetermined amount of movement (e.g., rotation) of the engaging member 120 and/or the ring gear 530 described previously. In addition, the pivot gears 1705 can allow for increase torque transfer to the engaging member 120 and cradle rotor 415.

Figure 18:
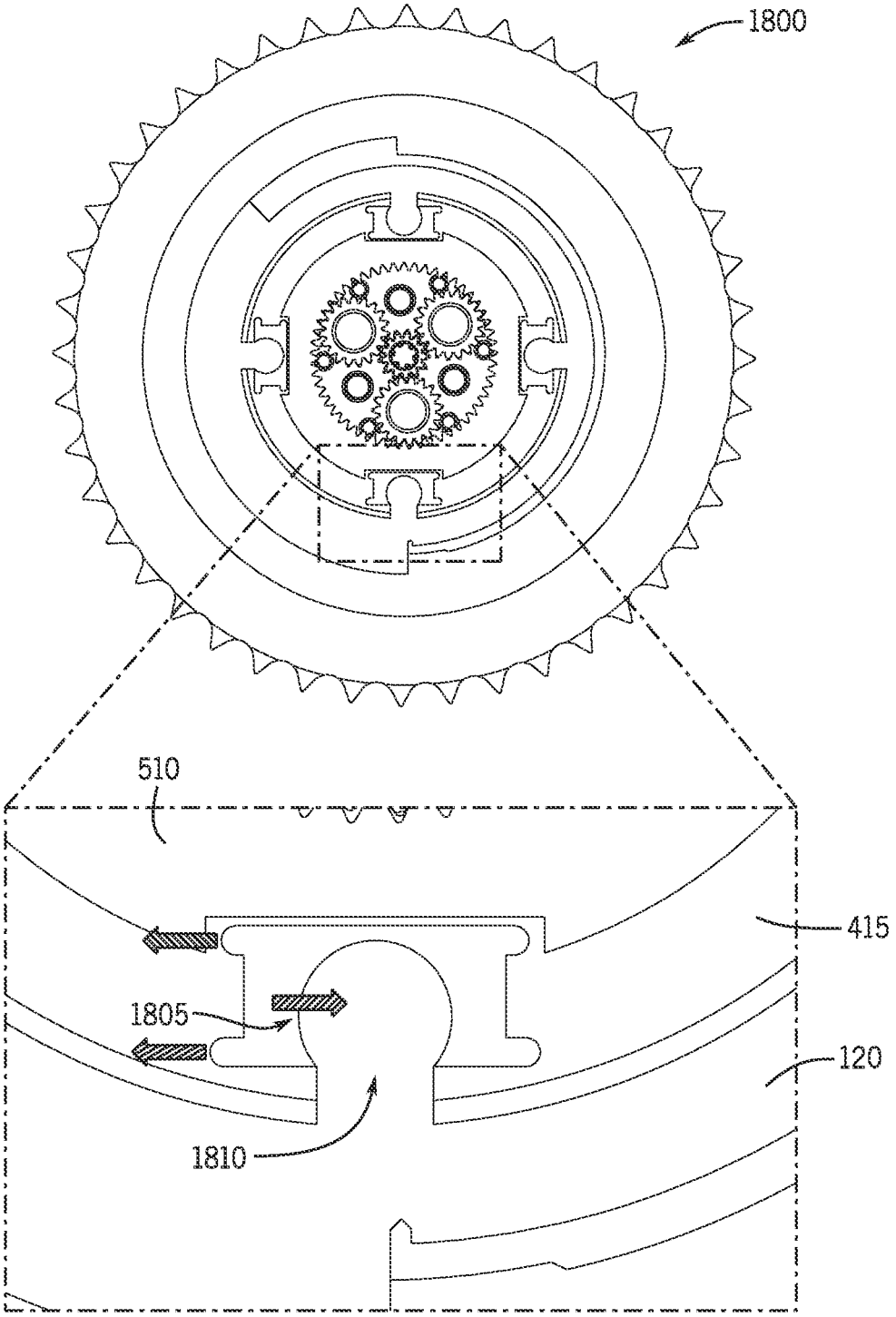
FIG. 18 is a perspective view of a portion of another example of a cam phaser according to another aspect of the present disclosure.

FIG. 18 illustrates another example of a cam phaser 1800. As will be recognized, the cam phaser 1800 shares a number of components in common with and operates in a similar fashion to the examples illustrated and described previously. For the sake of brevity, these common features will not be again described below in detail. Rather, previous discussion of commonly named or numbered features, unless otherwise indicated, also applies to example configurations of the cam phaser 1800.

The cam phaser 1800 may include a reaction mechanism with a pivot part 1805 configured to rotate about a corresponding pivot point 1810 protruding from the engaging member 120. In one example, the pivot part 1805 may generate an output force (e.g., a first output force or torque) on the engaging member 120 based on receiving an input force from the modular gear 510. In another example, the pivot part 1805 may generate an additional output force (e.g., a second output force or torque) on the cradle rotor 415, which increases the effective torque applied to the cradle rotor 415 (i.e., driven member 110) in order to remove the remainder forces. The first and second output torques can be in opposing rotational directions.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. A cam phaser comprising:

a drive member;

a driven member;

a locking mechanism coupling the drive member and the driven member to contact the drive member and the driven member in response to a first torque applied to the driven member that loads the locking mechanism;

an engaging member coupled to the locking mechanism to selectively actuate the locking mechanism to enable rotation of the driven member relative to the drive member; and a reaction mechanism coupled to an input mechanism to receive a second torque from the input mechanism, and coupled to the driven member to selectively transmit the second torque to the driven member to unload the locking mechanism and allow the locking mechanism to move from a locked state to an unlocked state.

2. The cam phaser of claim 1, wherein the drive member includes a first mating surface and the driven member includes a second mating surface.

3. The cam phaser of claim 2, wherein the locking mechanism is arranged between the first mating surface and the second mating surface.

4. The cam phaser of claim 1, wherein the drive member is configured to couple to a crankshaft, and the driven member is configured to couple to a camshaft.

5. The cam phaser of claim 1, wherein the locking mechanism comprises a first locking member and a second locking member, and wherein the first locking member and the second locking member are biased away from one another by a biasing element.

6. The cam phaser of claim 5, wherein each of the first locking member and the second locking member is configured as a roller bearing.

7. The cam phaser of claim 1, wherein the engaging member includes one or more tabs extending from a first surface, and wherein the one or more tabs are configured to engage with the locking mechanism to unlock the locking mechanism.

8. The cam phaser of claim 7, wherein the reaction mechanism is configured as a reaction gearbox that includes a planetary geartrain.

9. The cam phaser of claim 8, wherein the engaging member includes a post extending from a second surface, opposite the first surface, the post being configured to receive a planet gear of the planetary geartrain.

10. The cam phaser of claim 8, wherein the planetary geartrain includes a modular gear having first teeth that form a sun gear of the planetary geartrain of the reaction gearbox and second teeth configured to engage with the input mechanism.

11. The cam phaser of claim 8, wherein a ring gear of the planetary geartrain of the reaction gearbox defines a cutout configured to receive the driven member.

12. The cam phaser of claim 1, wherein the reaction mechanism is configured to selectively transmit the second torque to the engaging member to unlock the locking mechanism.

13. The cam phaser of claim 1, wherein when the locking mechanism is in an unloaded state, the engaging member is able to displace the locking mechanism.

14. The cam phaser of claim 13, wherein when the locking mechanism is in the unloaded state and the engaging member displaces the locking mechanism, the driven member is able to displace relative to the drive member.

15. The cam phaser of claim 1, wherein, in response to the second torque applied by the input mechanism, the reaction mechanism transmits a first output torque to the engaging member and a second output torque to the driven member, the first output torque and the second output torque being applied in opposite rotational directions.

16. A cam phaser comprising:

a drive member including a first mating surface;

a driven member including a second mating surface;

a locking mechanism arranged between the first mating surface and the second mating surface to contact the first mating surface and the second mating surface in response to a first torque applied to driven member that loads the locking mechanism;

an engaging member to selectively actuate the locking mechanism to enable rotation of the driven member relative to the drive member; and a reaction gearbox, wherein the reaction gearbox includes a planetary geartrain configured to selectively transmit a second torque from an input mechanism to the driven member to unload the locking mechanism and to selectively transmit the second torque to the engaging member to unlock the locking mechanism.

17. The cam phaser of claim 16, wherein the engaging member includes one or more tabs extending from a first surface, and wherein the one or more tabs are configured to engage with the locking mechanism to unlock the locking mechanism.

18. The cam phaser of claim 17, wherein the engaging member includes one or more posts extending from a second surface, opposite the first surface, and wherein the one or more posts are configured to receive one or more planet gears of the planetary geartrain.

19. The cam phaser of claim 16, wherein the planetary geartrain includes a modular gear having first teeth that form a sun gear of the planetary geartrain of the reaction gearbox and second teeth that form a ring gear for the input mechanism.

20. A method of operating a cam phaser, comprising:

applying an input torque to a reaction mechanism via an input mechanism;

generating a first output torque in a first direction on an engaging member of a cam phaser via a planet gear of the reaction mechanism; and generating a second output torque in a second direction, opposite from the first direction, on a driven member of the cam phaser via a ring gear of the reaction mechanism;

wherein the one or more planet gears are mounted on the engaging member; and wherein the driven member is secured within a portion of the ring gear such that rotation of the ring gear generates corresponding rotation in the driven member.

* * * * *